US006260487B1

(12) United States Patent
Giorgio

(10) Patent No.: US 6,260,487 B1
(45) Date of Patent: Jul. 17, 2001

(54) PALLET SKIRT

(76) Inventor: Mark B. Giorgio, 6679 S. 230 East, Midvale, UT (US) 84047

( * ) Notice: Subject to any disclaimer, the term of this patent is extended or adjusted under 35 U.S.C. 154(b) by 0 days.

(21) Appl. No.: 09/407,225

(22) Filed: Sep. 27, 1999

(51) Int. Cl.[7] ..... B65D 19/38
(52) U.S. Cl. ..... 108/51.11; 206/597
(58) Field of Search ..... 108/51.11, 55.5, 108/55.1, 56.1, 57.2, 57.33; 206/596, 597, 598, 386; 53/399; 150/154

(56) References Cited

U.S. PATENT DOCUMENTS 5,944,370 * 8/1999 Ravet et al. ..... 206/597 X
5,972,464 * 10/1999 Pezzuco ..... 206/597 X
6,050,419 * 4/2000 Flanagan et al. ..... 206/597

* cited by examiner

*Primary Examiner*—Peter M. Cuomo
*Assistant Examiner*—Michael J. Fisher
(74) *Attorney, Agent, or Firm*—Morriss, Bateman, O'Bryant & Compagni, P.C.

(57) ABSTRACT

A pallet skirt useful for covering a pallet to improve aesthetics and reduce the risk of tripping over the pallet includes an elongate piece of material for surrounding at least a portion of the pallet and fasteners which fasten the elongate piece of material to the pallet.

18 Claims, 4 Drawing Sheets

PALLET SKIRT

BACKGROUND OF THE INVENTION

1. Field of the Invention

The present invention relates a pallet skirt for encircling a pallet. More particularly, the present invention relates to an elongate member which wraps around a pallet used for carrying merchandise, etc., so that the elongate member improves the appearance of the pallet and decreases the risk of accidental injuries caused by the pallet.

2. State of the Art

Pallets have been used for decades to hold and transport merchandise. Typically a pallet includes a generally planar upper surface upon which merchandise is stacked, and a support frame disposed beneath the planar upper surface. The support structure is typically formed to provide openings into which the prongs of a fork lift can slide. The fork lift is thus able to engage the pallet and carry the pallet and its load to a desired location.

For many years pallets were used for storage and transport, but not for commercial display. When the product on the pallet was needed, it was removed from the pallet and placed on shelves, etc. While transferring the product was time consuming, a more pleasing commercial impression was provided.

The rapid increase in the popularity of "discount" and "warehouse" stores has brought a major increase in the use of pallets. Because pallets can hold a substantial amount of product and can be moved rapidly, many discount and warehouse stores have turned to using simply using a pallet as the base of a display. The pallet full of product can be brought into the store and left at the end of an aisle without the considerable amount of time consumed in transferring the product onto shelves, etc.

The use of pallets as part of a display has two major drawbacks. First, pallets are generally formed from low grade pieces of wood and often endure considerable abuse during transport. Thus, the pallet is generally not aesthetically pleasing and can be quite an eyesore.

Second, as mentioned above, the pallets typically have openings designed for receiving the prongs of a forklift. Unfortunately, the human foot is slightly thinner than the prong of a forklift. If is not uncommon for customers and even store employees to accidentally catch their foot on the pallet while walking past. In most cases, this is merely an irritant and results in a sore toe. A fall caused by accidentally catching the pallet, however, can cause serious injuries and presents significant liability concerns for the stores.

To alleviate some of the aesthetics concerns, some companies have prepared special displays in which part of the display covers at least a portion of the pallet to provide a more attractive image. Such displays, however, must be specially prepared and generally relate to the product originally loaded on the pallet. If another product is later loaded onto the pallet, the display is unlikely to be consistent with the product. Also, such displays are often designed for use on a particular size of pallet.

In light of these concerns, there is a need for an improve apparatus and method for use with pallets. Such an apparatus and method should improve the aesthetics associated with use of the pallet. Such an apparatus and method should also minimize the risks associated with use of the pallet.

SUMMARY OF THE INVENTION

Thus, it is an object of the present invention to provide an apparatus which covers a pallet to improve the aesthetics associated with the display of products on a pallet.

It is another object of the present invention to provide a method for improving the aesthetics associated with the display of products on a pallet.

It is yet another object of the present invention to provide an apparatus which covers portions of a pallet to minimize accidents caused by people catching their feet in the openings of a pallet.

It is still yet another object of the present invention to provide a method for minimize accidents caused by people catching their feet in the openings of a pallet.

The above and other objects of the invention are realized in specific illustrated embodiments of a pallet skirt including generally an elongate piece of material, and an attachment mechanism for securing the elongate piece of material to the pallet. The elongate piece of material may be secured to the pallet and wrapped around the pallet to cover the perimeter of the pallet and thereby keep it from being visible to consumers, etc.

In accordance with one aspect of the invention, the elongate piece of material is formed from a flexible piece of material which can be wrapped around the perimeter of the pallet. When provided with an adjustable fastening mechanism, the elongate piece of flexible material may be used with pallets having differing peripheral dimensions. In accordance with a presently preferred embodiment, the elongate flexible material is formed from a plastic-like material which provides a small amount of resiliency so that the flexible material tends to tighten slightly against the pallet after it has been secured.

It accordance with another aspect of the invention, an adjustable fastening mechanism can be used to hold the end of the elongate material to a central portion of the elongate material to facilitate use on pallets of a number of different sizes. The presently preferred attachment means is hook and loop fastener, such as VELCRO, but other adjustable fastening mechanisms may be used.

BRIEF DESCRIPTION OF THE DRAWINGS

The above and other objects, features and advantages of the invention will become apparent from a consideration of the following detailed description presented in connection with the accompanying drawings in which.

DETAILED DESCRIPTION

Reference will now be made to the drawings in which the various elements of the present invention will be given numeral designations and in which the invention will be discussed so as to enable one skilled in the art to make and use the invention. It is to be understood that the following description is only exemplary of the principles of the present invention, and should not be viewed as narrowing the pending claims.

Figure 1:
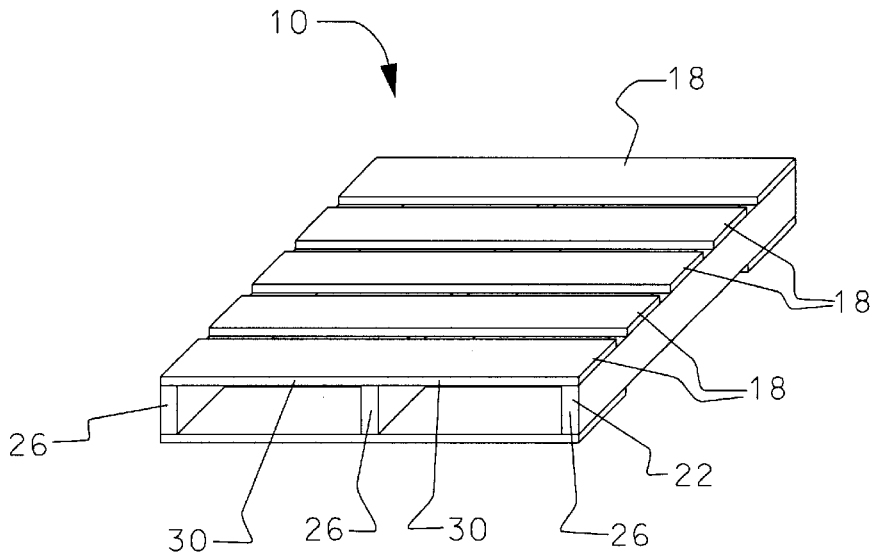
FIG. 1 shows a perspective view of a pallet holding product in accordance with the use of pallets in accordance with the teachings of the prior art.

Referring to FIG. 1, there is shown a perspective view of a pallet, generally indicated at 10, which is well known in the prior art. The pallet 10 includes an upper surface 14 which is generally planar and which commonly is formed by a plurality of boards 18. In other configurations, the upper surface may be formed of a continuous piece of plastic or wood.

Disposed beneath the boards 18 forming the planar surface 18, is a frame 22. The frame 22 is formed by a plurality of boards 26 in such a manner that a pair of openings 30 are formed in the pallet 10. To transport the pallet and any product, etc., placed thereon, the prongs of the fork lift are slid into the openings 30 and then the pallet and its contents are lifted by the fork lift.

Unfortunately, in addition to the lack of aesthetic appeal associated with using a beat-up pallet inside a store, using the pallet 10 to hold products on display presents a tripping hazzard. It is not uncommon for a person walking past a pallet to catch his or her foot in the opening of the pallet. Because most stores have tile or concrete floors, the injuries resulting from the fall can be severe. Thus, use of the pallet 10 can also present a liability concern for the store.

Figure 2:
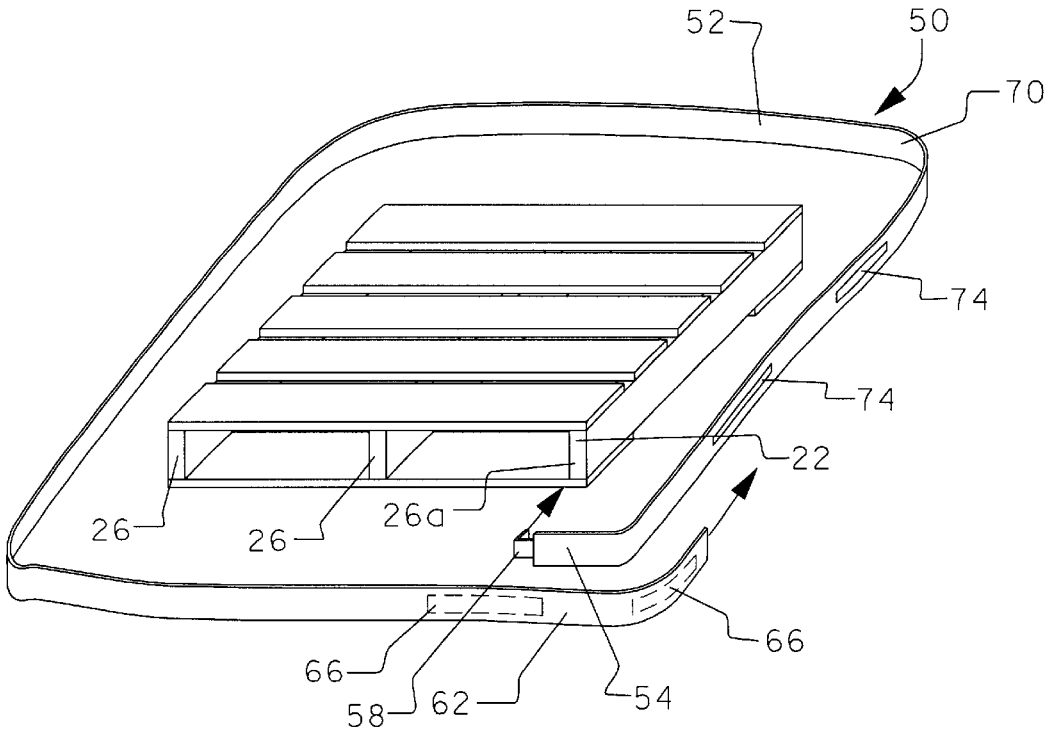
FIG. 2 shows a pallet skirt formed in accordance with the principles of the present invention being wrapped around a conventional pallet.

Turning now to FIG. 2, there is shown a pallet skirt, generally indicated at 50, formed in accordance with the principles of the present invention. The pallet skirt 50 is being wrapped around the conventional pallet 10 so as to cover the perimeter of the pallet to improve aesthetics and safety.

The pallet skirt 50 is preferably formed of an elongate piece of material 52 which has a first end 54 which typically has a fastener 58 configured for engaging the frame 22 of the pallet 10. As shown in FIG. 2, the fastener is a U-shaped bracket which is approximately 1.5 inches wide so that it can securely engage the '2×4' 26*a* which forms part of the frame 22.

An opposing second end 62 of the pallet skirt 50 has a fastener 66 attached thereto to enable the second end of the pallet skirt to be attached to a mid-portion 70 of the pallet skirt and thereby secure the second end. As shown in FIG. 2, the fastener 66 on the second end 62 is hook and loop fastener, commonly referred to as VELCRO. Matching pieces of hook and loop fastener 74 are disposed along the mid-portion 70 of the pallet skirt 50 for securing the second end 62. By providing a plurality of pieces of the matching hook and loop fastener 74, the pallet skirt becomes adjustable so that it can be used with different sized pallets.

Figure 3:
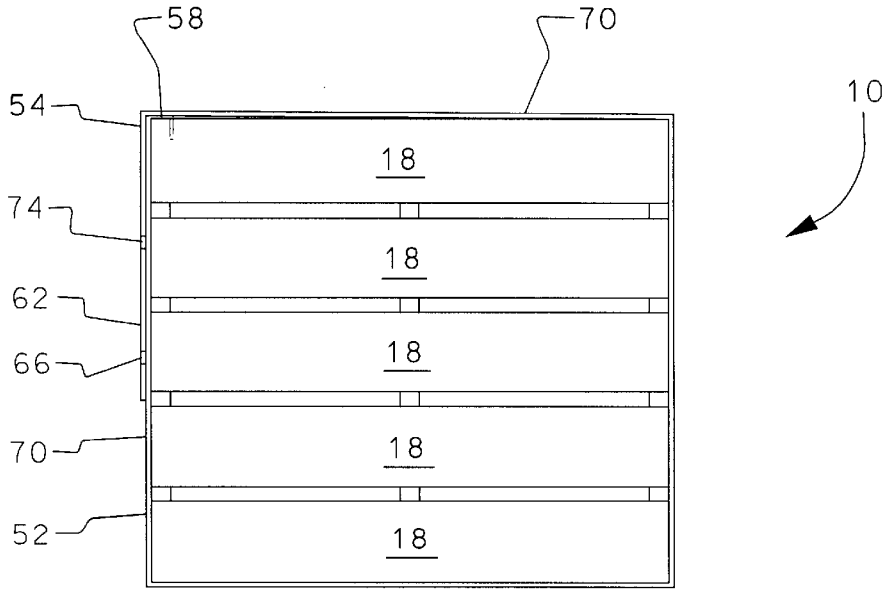
FIG. 3 shows a top view of the pallet skirt of FIG. 2 wrapped around the exterior of a pallet.

FIG. 3 shows a top view of the pallet skirt 50 of FIG. 2 wrapped around the exterior of the pallet 10. The first end 54 of the pallet skirt is held to the frame 22 of the pallet 10 by the fastener 58. The mid-portion 70 of the pallet skirt 50 has been wrapped around the pallet so as to cover all four sides, and especially the openings (not shown in FIG. 3) at either end of the pallet. The second end 62 is secured to the mid-portion 70 by the fasteners 66 and 74. In such a configuration, the pallet skirt 50 surrounds the perimeter of the pallet 10 to improve aesthetics, while at the same time substantially reducing the risk that a customer or employee may trip over the pallet.

In order to facilitate use of the pallet skirt 50 with pallets of different sizes, it is preferred that the entire mid-portion be made of a flexible material. One material which works well is the rubber-like material used for "rubber" baseboards for walls. This material is desirable because it is flexible and slightly resilient. As it is wrapped firmly around the pallet 10, it tends to mold to the corners and does not extend outwardly any significant distance. It is also strong enough to help prevent a foot entering the opening it covers.

Figure 4A:
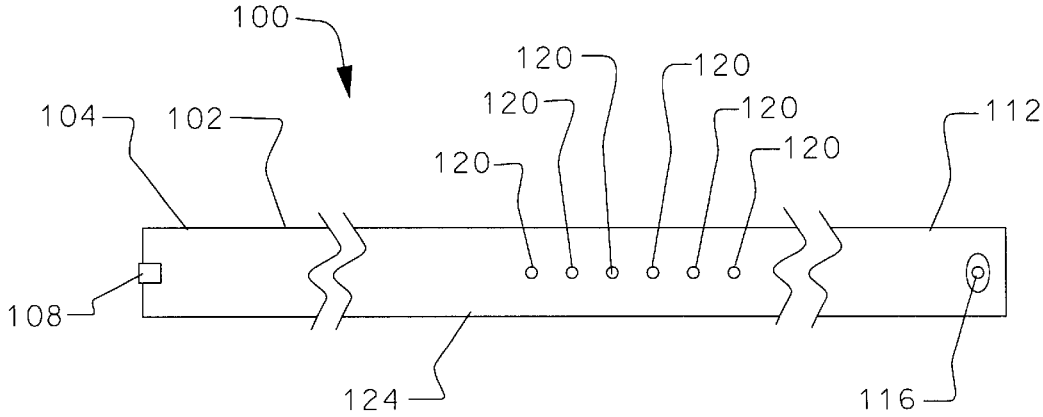
FIG. 4A shows a fragmented view of a pallet skirt made in accordance with the teachings of the present invention.

Turning now to FIG. 4A, there is shown a fragmented view of a pallet skirt, generally indicated at 100, made in accordance with the teachings of the present invention. The pallet skirt 100 formed of a piece of elongate material 102 which includes a first end 104 which is configured with a fastener 108 configured for attachment to a pallet. The elongate material 102 also have an opposing second end 112 with a fastener 116. As shown in FIG. 4A, the fastener 116 comprises an outwardly extending nub. The nub 116 can be placed in any one of a number of holes 120 formed in the midportion 124 of the elongate piece of material 102.

The plurality of holes 120 provide an adjustment feature so that the pallet skirt 100 may be used with pallets of different sizes. The first end 104 of the pallet skirt 100 is anchored to the pallet by the fastener 102 in a similar manner as that shown in FIG. 2. The mid-portion 124 is then wrapped around the pallet until the second end 112 passes over the first end 104 and the fastening nub 116 fits into a corresponding hole 120 on the mid-portion 124. On larger pallets, the fastening nub 116 will nest in a hole closer to the first end 104, and on a smaller pallet, it will nest in a hole closer to the second end 112.

Figure 4B:
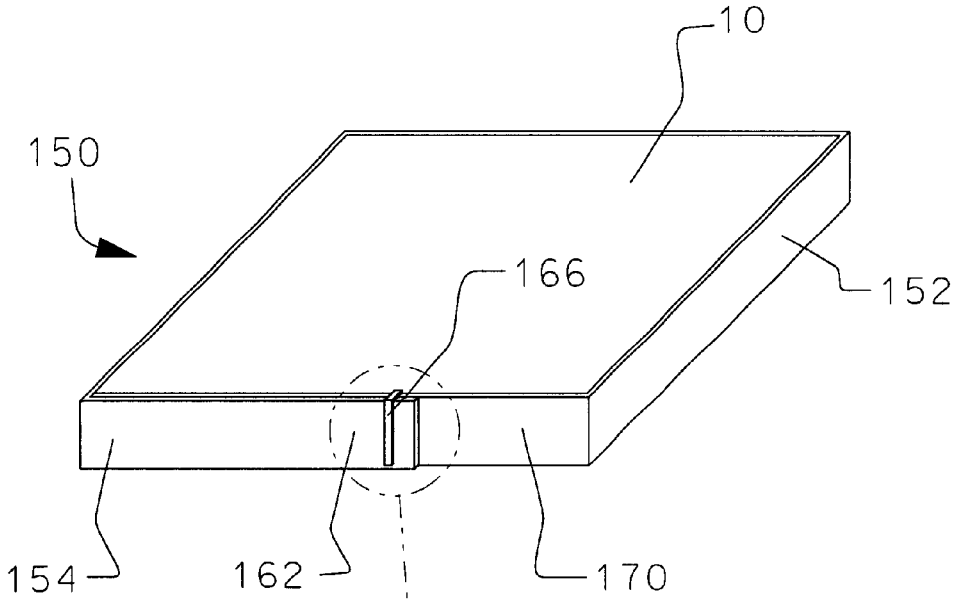
FIG. 4B shows a perspective view of another embodiment of a pallet skirt formed in accordance with the principles of the present invention.
Figure 4C:
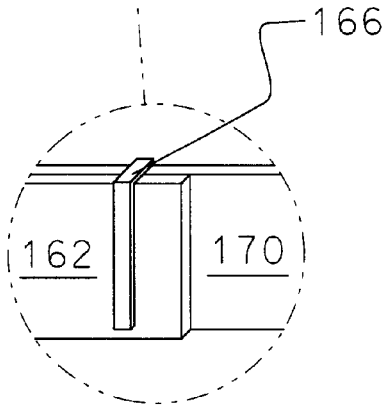
FIG. 4C shows a close-up view of the embodiment shown in FIG. 4B.

FIGS. 4B and 4C show another embodiment of a pallet skirt, generally indicated at 150 wrapped around a pallet 10. The pallet skirt 150 is formed of an elongate piece of material 152. At a first end, 154, the material is preferably secured to the pallet 10 by a fastener (not shown). At an opposing second end 162, a biased pin 166 is used to fasten the second end to the mid-portion 170 of the pallet skirt 150. In this regard, the pin 166 will typically having an open channel which is slightly smaller than the mid-portion 170 and second end 162 combined. Thus, when the two are slid into the channel, the pin will squeeze the two together and fasten the second end.

Figure 4D:
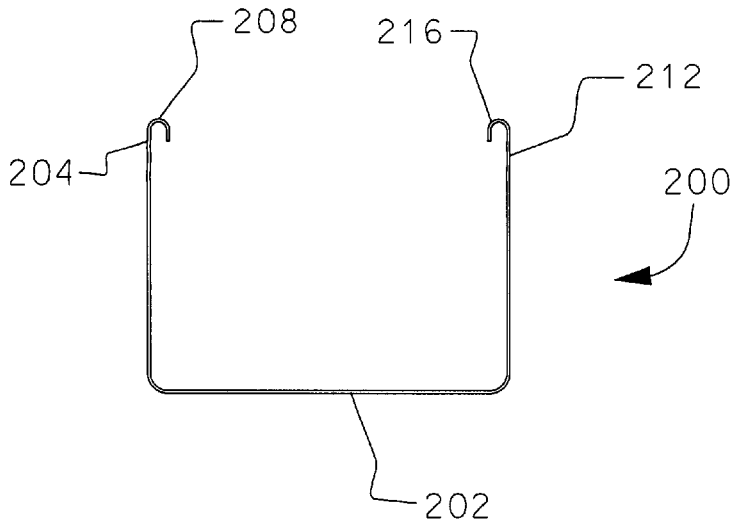
FIG. 4D shows a top view of yet another embodiment of a pallet skirt formed in accordance with the principles of the present invention.

Turning now to FIG. 4D, there is shown yet another embodiment of a pallet skirt, generally indicated at 200. While the previously disclosed embodiments are preferred in that they surround the perimeter of the pallet to cover the openings on both sides of the pallet, the pallet skirt 200 can be used in situations in which one side of the pallet is disposed against the end of an aisle, etc., so that the opening at one end will not be exposed.

The pallet skirt 200 is formed of an elongate piece of material 202 having a first end 204 configured for attachment to a pallet. As shown in FIG. 4D, the first end has a fastener 208 in the form of a bracket sized to engage the frame of the pallet (not shown). An opposing second end 212 also has a fastener 216 which is configured to attach to the pallet. Typically the fastener 216 will be formed from a bracket similar to that used at the first end.

The elongate material 202 also has a mid-portion which is disposed between the first end 204 and the second end 212. The mid-portion 220 covers those portions of the perimeter of the pallet which are exposed and which may either by aesthetically displeasing or which pose a tripping hazzard. While the fasteners shown in FIG. 4D are not adjustable to accommodate for different sized pallets, those skilled in the art will appreciate the adjustable fasteners could be used in accordance with the principles of the present invention.

Figure 5:
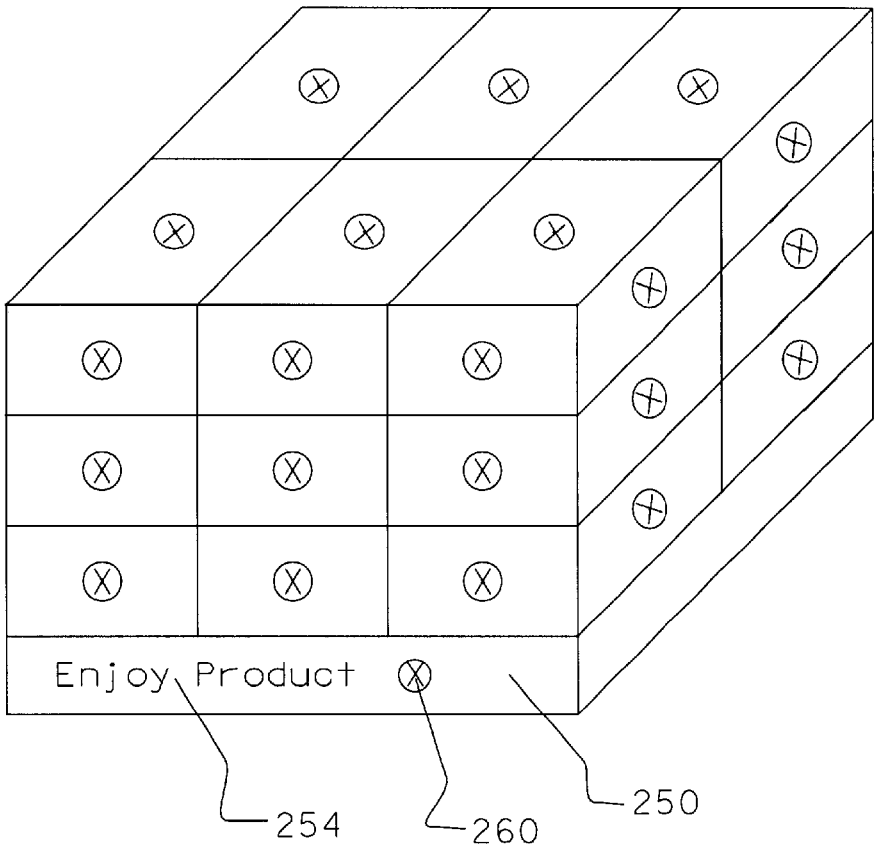
FIG. 5 shows a perspective view of a pallet skirt wrapped around a pallet in accordance with still yet another aspect of the present invention.

Turning now to FIG. 5, there is shown a pallet having its perimeter covered by a pallet skirt 250 in accordance with the principles of the present invention. The pallet skirt 250 covers the pallet in such a manner that the pallet is not visible, and in such a manner that the risk of tripping over the pallet is reduced. Thus aesthetics and safety are increased.

In addition to the above, however, the pallet skirt 250 can also have writing or logos 254 placed on the mid-portion 260 or the second end 264. Thus, the pallet skirt 250 also serves as an advertising medium. If desired, the message on the pallet skirt 250 could be tied to the goods which are disposed on the pallet. In the alternative, it could relate to the store which is selling the product.

Thus there is disclosed a pallet skirt which improves aesthetics and safety, while providing an additional medium for advertising. Those skilled in the art will appreciate numerous modifications which can be made without departing from the scope and spirit of the present invention. For example, other fasteners could be used to secure the pallet skirt to the pallet, such as releasable adhesives, etc. Likewise, materials other than the preferred materials disclosed herein could be used for the elongate piece of material. The appended claims are intended to cover such modifications.

What is claimed is:

1. A pallet skirt for surrounding a pallet, the pallet skirt comprising:

an elongate piece of flexible material the elongate piece of flexible material having a first end and a second end and a mid-portion disposed between the first and second end;

a first fastener configured for securing the first end to a pallet such that the elongate piece of material extends around the pallet to thereby cover the outside of the pallet, the first fastener comprising a bracket attached to the first end of the elongate material; and a second fastener configured for securing the second end of the elongate piece of flexible material to the elongate piece of material over the first end or the mid-portion and thereby hold the elongate piece of flexible material about the pallet.

2. The pallet skirt of claim 1, wherein the bracket is configured for securing the first end to a '2×4' forming a portion of the pallet.

3. The pallet skirt of claim 1, wherein the second fastener comprises hook and loop fastener.

4. The pallet'skirt of claim 1, wherein the second fastener comprises a nub, and wherein the mid-portion of the elongate piece of material has at least one hole for receiving the nub.

5. The pallet skirt of claim 1, wherein the second fastener comprises a pin configured for holding the second end adjacent to the mid-portion of the elongate piece of material.

6. The pallet skirt of claim 1, wherein the second fastener comprises a bracket configured for securing the second end of the piece of elongate material to the pallet.

7. The pallet skirt of claim 1, wherein the elongate piece of material is formed from a resilient material.

8. A pallet skirt for securing around a pallet to cover openings in the side thereof, the pallet skirt comprising;

an elongate piece of flexible material having a first end, a second end and a mid-portion between the first and second ends, the mid-portion being sufficiently long to circumscribe the pallet, and the elongate piece of flexible material being substantially as wide as the height of the pallet;

a fastener attached to the first end, the fastener comprising a bracket configured for attachment to the frame of the pallet so as to hold the first end of the elongate piece of material to the pallet; and a fastener associated with the second end for holding the second end of the elongate piece of material in a position overlying the mid-portion of the elongate piece of material, when the mid-portion is wrapped around the pallet.

9. A method for covering the perimeter of a pallet comprising:

(a) selecting a pallet;

(b) selecting a pallet skirt having a first end configured for attachment to the pallet, a contiuously flexible mid-portion sufficiently long to cover at least two sides of the pallet, and a second end having a fastener for holding the second end to the mid-portion adjacent to the pallet;

(c) securing the first end to the pallet;

(d) extending the flexible mid-portion to cover at least one side of the pallet; and (e) securing the second end to the mid-portion adjacent to the pallet.

10. The method according to claim 9, wherein the method comprises selecting a pallet wherein the mid-portion is of sufficient length to surround at least three sides of the pallet.

11. The method according to claim 9, wherein the method comprises attaching the first end to the pallet and wrapping the elongate piece of material completely around the perimeter of the pallet.

12. The method according to claim 9, wherein the method comprises wrapping the mid-portion about the perimeter of the pallet and securing the second end to the mid-portion.

13. The method according to claim 12, wherein the second end is attached to the mid-portion by an adjustable fastener.

14. The method according to claim 13, wherein the method comprises attaching the second end to the mid-portion by hook and loop fastener.

15. The method according to claim 9, wherein the method includes selecting the piece of material, wherein the piece of material has an adjustable fastener mechanism attached to the second end.

16. A method for covering the perimeter of a pallet comprising:

(a) selecting a pallet;

(b) selecting an elongate piece of continuously flexible material having a first end configured for attachment to a pallet; and (c) attaching the first cad to the pallet; and (d) wrapping the elongate piece of flexible material about the pallet to cover at least three sides of the pallet and thereby cover openings in the pallet.

17. The method according to claim 16, wherein the method comprises selecting the elongate piece of material having a first end and attaching the first end to the pallet.

18. The method according to claim 17, wherein the method comprises selecting the elongate piece of material with a second end and wrapping the elongate piece of material around the pallet and securing the second end to the elongate piece of material with a fastener.

* * * * *